US007040919B2

(12) United States Patent
Yao

(10) Patent No.: US 7,040,919 B2
(45) Date of Patent: May 9, 2006

(54) USB PLUG WITH TWO SIDES ALTERNATELY CONNECTABLE TO A USB PORT

(76) Inventor: Li-Ho Yao, 4F, No. 99, Tungan St., Taipei (TW)

( * ) Notice: Subject to any disclaimer, the term of this patent is extended or adjusted under 35 U.S.C. 154(b) by 27 days.

(21) Appl. No.: 10/922,134

(22) Filed: Aug. 18, 2004

(65) Prior Publication Data

US 2006/0040549 A1 Feb. 23, 2006

(51) Int. Cl.
*H01R 11/00* (2006.01)

(52) U.S. Cl. ..... 439/502

(58) Field of Classification Search ..... 439/502, 439/528, 131, 172, 532; 361/741, 747, 752, 361/755–756, 764
See application file for complete search history.

(56) References Cited

U.S. PATENT DOCUMENTS 6,139,365 A * 10/2000 Lok ..... 439/607
6,435,409 B1 * 8/2002 Hu ..... 235/441
6,567,273 B1 * 5/2003 Liu et al. ..... 361/737
6,802,512 B1 * 10/2004 Muller et al. ..... 277/607
2005/0085129 A1 * 4/2005 Chiou et al. ..... 439/607

* cited by examiner

*Primary Examiner*—J. F. Duverne
(74) *Attorney, Agent, or Firm*—Dellett & Walters

(57) ABSTRACT

A universal series bus (USB) has a grille-like top frame, a bottom frame and a circuit board mounted between the top frame and the bottom frame. Both the top and bottom frames are defined with multiple corresponding slots, and accordingly a rib is formed between each two adjacent slots. The circuit board has a top side and a bottom side, wherein USB contacts are formed on both sides and correspond to the slots. Therefore, when the USB plug is inserted into a standard USB port, the USB contacts formed on one side correspondingly touch the conductive pins. On the other side of the USB plug, since the protruding ribs abut against resilient metal tongues inside the USB port, the contacts on the other side will not touch to the metal tongues thus avoiding the occurrence of short circuit.

8 Claims, 5 Drawing Sheets

USB PLUG WITH TWO SIDES ALTERNATELY CONNECTABLE TO A USB PORT

BACKGROUND OF THE INVENTION

1. Field of the Invention

The present invention relates to a universal serial bus (USB) plug, and more particularly to a USB plug with contacts formed at its bottom and top sides thus allowing the USB plug to electrically insert into a standard USB port in more than one position.

2. Description of Related Art

Peripheral products for personal computers such as keyboards, mice, printers, scanners, CCD cameras, digital cameras as well as MP3 players are becoming increasingly important everyday tools to people. In the past, conventional parallel or serial ports were able to satisfy consumers' demands but then became inadequate due to so many peripherals being required for daily operations. Hence, the universal serial bus (USB) protocol was developed as a universal data transmission interface between personal computers and peripheral products.

The USB protocol supports useful functions such as hot plug as well as plug and play. The versatility provided by the USB protocol means that all USB products can be easily installed and operated. Further, a single USB port can be shared by a maximum quantity of 127 different devices. In comparison to the conventional USB 1.1 protocol, a new USB 2.0 protocol not only retains normal transmission modes (1.5 Mbits/s and 12 Mbit/s) and supports the prior USB 1.1 protocol, but also provides a higher speed data transmission (480 Mbits per second).

Whether using the conventional or present USB protocols, the same specification for USB architecture is employed. The architecture of the present USB plug is designed to be inserted in a USB port in only a single direction so that contacts formed on the USB plug and the USB port can correspondingly touch to each other. If the USB plug is not correctly aligned with the USB port it is not able to be inserted properly since a plastic platform formed in the USB port will block the plug.

For some particular USB products, the limitation that the USB plug can only be linked into the port with a particular direction is very inconvenient. For example, with reference to FIG. 6, a memory card (60) is integrated with a USB plug (61) for connection to a USB port (62) on a panel. However, other serial or parallel ports (63) adjacent to the USB port (62) may abut against an edge of the memory card (60) so that the plug (61) will be blocked at the outside of the USB port (62). If the two sides of the USB plug (61) both have contacts formed thereon, the USB plug (61) can be successfully linked to the port (62) just by turning the memory card (60) as well as the USB plug (61) over.

Therefore, the invention provides a novel USB plug to obviate the aforementioned problem.

SUMMARY OF THE INVENTION

The main objective of the present invention is to provide a universal serial bus (USB) plug with contacts formed at its bottom/top sides so that the USB plug is able to be inserted into a USB port in more than one position. To accomplish the objective, the USB plug comprises:

a top frame formed by a rectangular body on which slots are defined through the body, multiple ribs accordingly formed among the slots wherein each rib is formed between two adjacent slots;

a bottom frame formed by a rectangular body on which the slots are defined through the body and correspond to the slots of the top frame, multiple ribs accordingly formed among the slots, wherein each rib is formed between two adjacent slots;

a circuit board mounted between the top frame and the bottom frame, wherein the circuit board has a top side and a bottom side, and four standard USB contacts respectively formed on both the top side and the bottom side near a front end of the circuit board to correspond to the slots of the top frame and the bottom frame.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
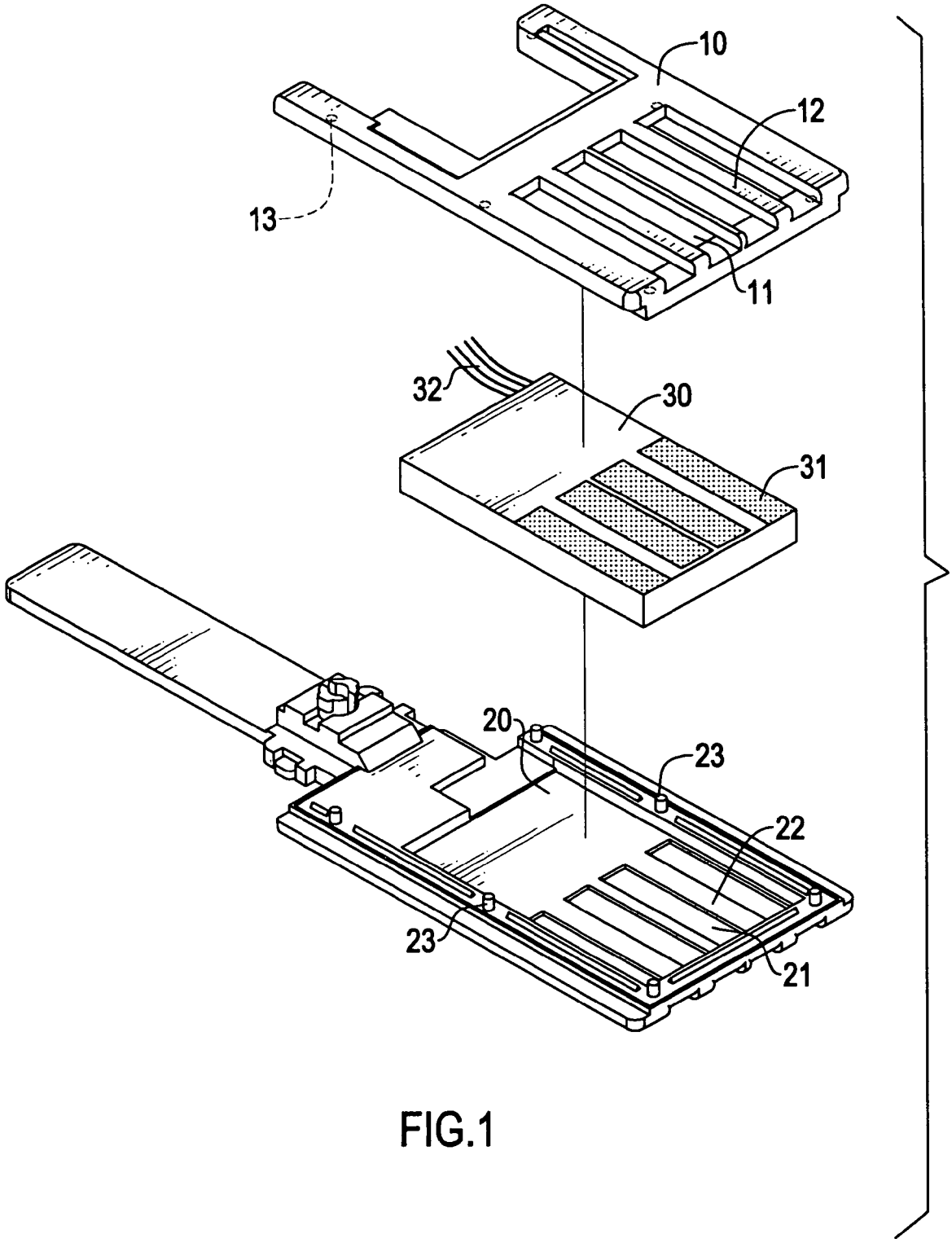
FIG. 1 is an exploded perspective view of a USB plug in accordance with the present invention.

With reference to FIG. 1, a USB plug in accordance with the present invention comprises a grille-like top frame (10), a bottom frame (20) and a circuit board (30) mounted between the top frame (10) and the bottom frame (20). Both the top frame (10) and the bottom frame (20) are made with non-conductive material such as plastic.

The fence-like top frame (10) is formed by a rectangular body on which four long and narrow slots (11) are defined through the body. Multiple ribs (12) are accordingly formed among the slots (11), where each rib (12) is formed between two adjacent slots (11). The top frame (10) further has multiple small concave dimples (13) defined at a bottom surface of two opposite long edges.

The bottom frame (20) has a similar architecture to the top frame (10). The bottom frame (20) also has ribs (22) and four slots (21). Complementary to the dimples (13) of the top frame (10), multiple protruding stubs (13) are formed on a top surface of two opposite long edges of the bottom frame (20). When the circuit board (30) is fitted between the frames (10)(20) and the frames (10)(20) are then assembled together. The peripheries of the frames (10)(20) can be further jointed via an ultrasonic welding technique.

The circuit board (30) has a top side and a bottom side. Four standard USB contacts (31) are formed on both the top side and the bottom side near a front end of the circuit board (30). Multiple wires (32) are connected to a rear end of the circuit board (30). When the circuit board is (30) is inserted between the frames (10)(20), the contacts (31) on the top/bottom sides correspond exactly with the slots (11)(21) of the top/bottom frames (10)(20).

Figure 2:
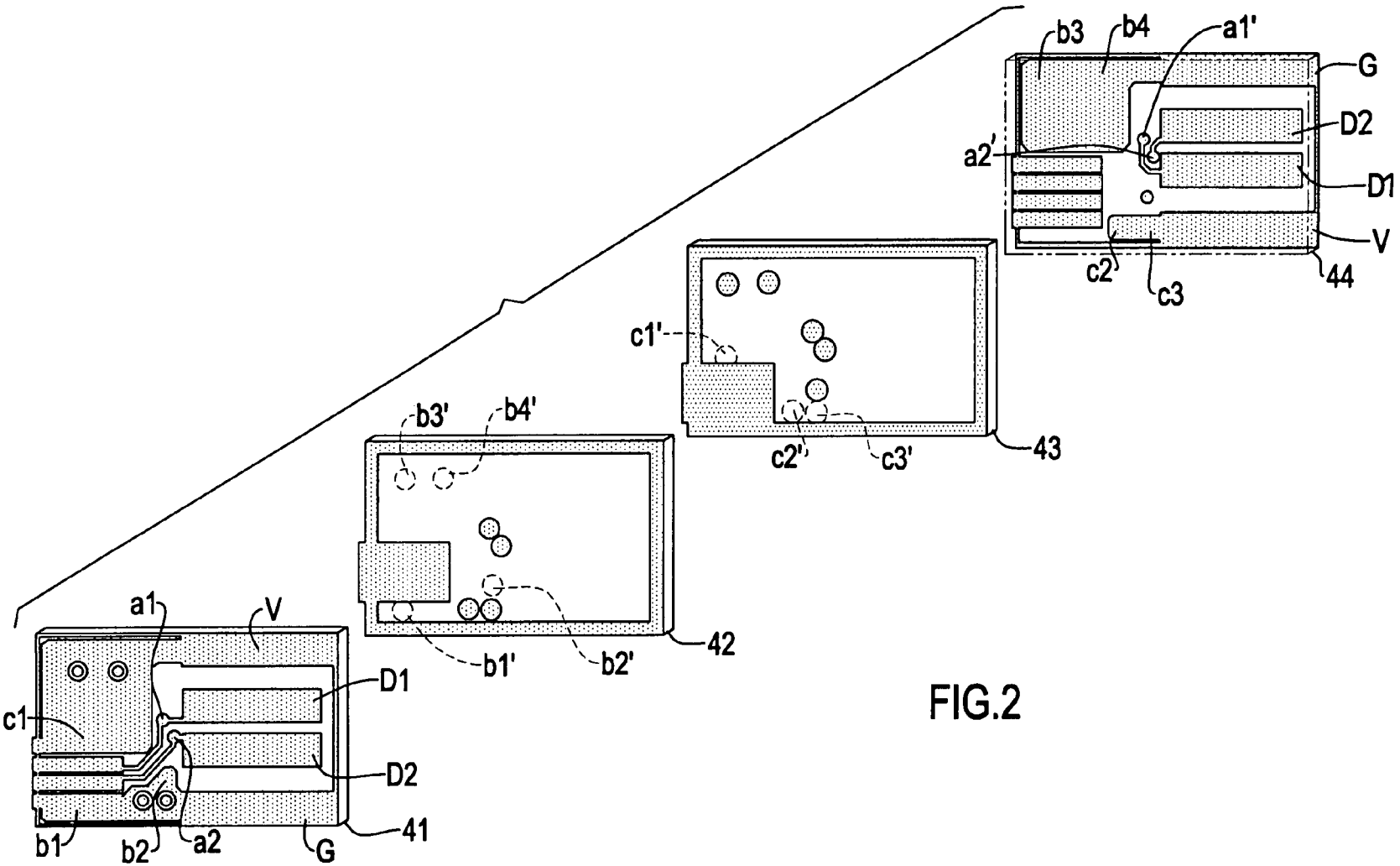
FIG. 2 is an exemplary exploded perspective view showing circuit layouts on different layers of the USB plug in accordance with the present invention.

With reference to FIG. 2, the circuit board (30) is constructed from multiple circuit layers (41)–(44). The first layer (41) and the fourth layer (44) are for forming the aforementioned USB contacts (31). The second layer (42) is used as a ground plate. The third layer (43) is to provide an operating voltage (VCC). It is noted that the blank regions on the first layer (41) and the fourth layer (44) represent that there is no conductive material printed thereon. On the contrary, the blank regions on the second layer (42) and the third layer (43) represent that conductive material are printed thereon. Therefore, most of the second layer (42) forms the ground plate, and most of the third layer (43) is able to provide the operating voltage.

Double concentric circles formed on the first layer (41) represent non-conductive through holes. Blank circles depicted with broken lines shown on the second layer (42) and the third layer (43) mean conductive through holes that are electrically contacted with the ground plate or the voltage plate. On the contrary, solid circles shown on the second layer (42) and the third layer (43) represent non-conductive through holes that are not electrically contacted with the ground plate or voltage plate.

The four USB contacts formed on the first layer (41) and the second layer (44) are respectively denoted with V (the operating voltage pin), D1 (the first data pin), D2 (the second data pin) and G (the ground pin). The two USB contacts D1 and D2 on the first layer (41) are respectively electrically connected with conductive through holes a1 and a2. The two conductive through holes a1 and a2 further interconnect to two conductive through holes a1' and a2' of the fourth layer (44) through the second and the third layers (42)(43). By overlapping the first layer (41) on the fourth layer (44), it can be found that circuit traces (not numbered) connecting the through holes a1 and a2 are intersected with the circuit traces connecting the through holes a1' and a2'.

The ground pin G of the first layer (41) provides two points b1 and b2 for electrically connecting to conductive holes b1' and b2 of the second layer (42). The voltage pin V of the first layer (41) provides a point c1 to electrically interconnect to the conductive hole c1' of the third layer (43).

For the fourth layer (44), the ground pin G provides two points b3 and b4 to electrically connect to conductive holes b3' and b4' of the second layer (42). The voltage pin V of the fourth layer (44) uses two points c2 and c3 to electrically interconnect to the conductive holes c2' and c3' of the third layer (43).

Figure 4:
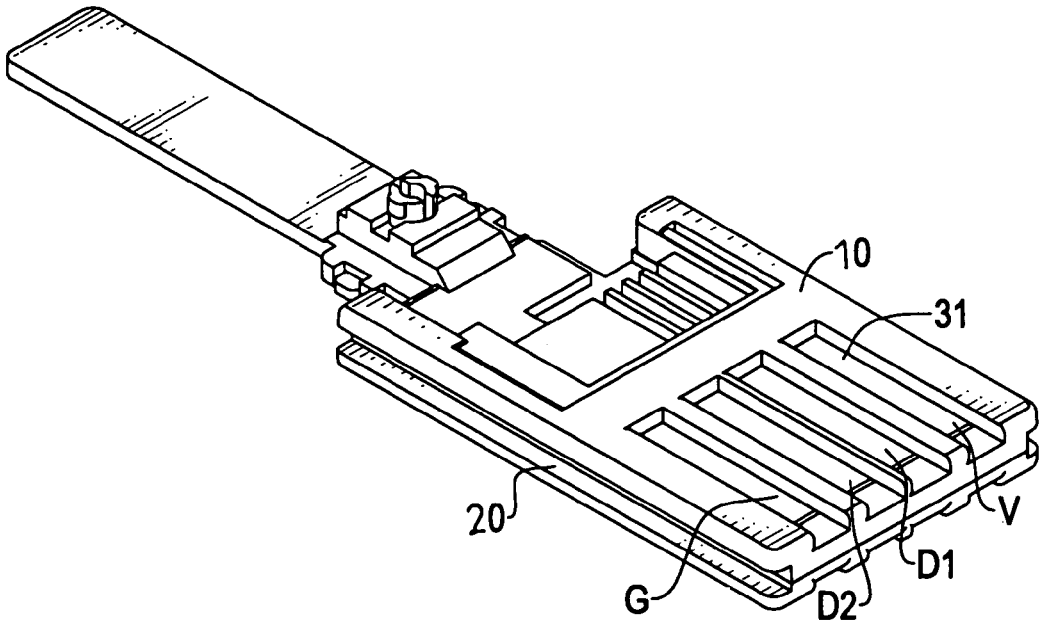
FIG. 4 is another perspective view of the USB plug in accordance with the present invention, wherein the USB plug is turned over from the status of FIG. 3.
Figure 3:
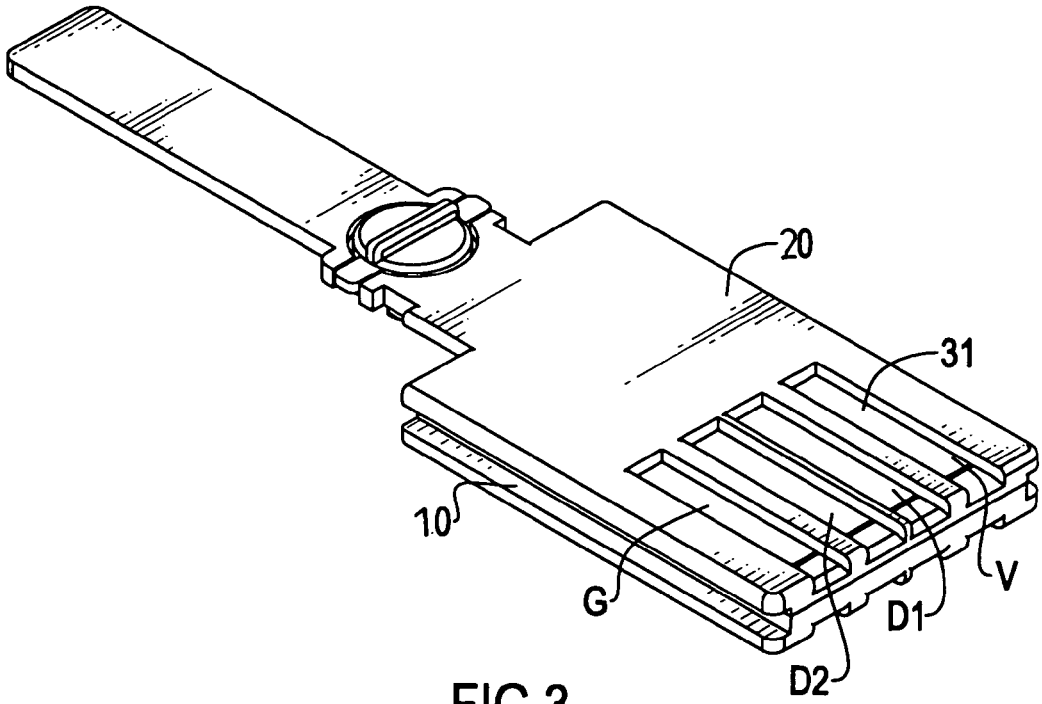
FIG. 3 is a perspective view of the USB plug in accordance with the present invention.

With reference to FIGS. 3 and 4, either from the top view or the bottom view of the USB plug in accordance with the present invention, these USB contacts (31) are all arranged in the same sequence. As shown in FIG. 3, along a direction from the left to right (indicated by an arrow A), the arrangement of the USB contacts (31) are in the turn of the ground pin (G), the second data pin (D2), the first data pin (D1) and the voltage pin (V). After the USB plug is turned over as shown in FIG. 4, the arrangement sequence of the USB contacts (31) from the left to right (indicated by an arrow A') is the same as FIG. 3. Since the USB contacts (31) of the bottom or top sides have the same order, the USB plug in accordance with the present invention is able to be arbitrarily inserted into a standard USB port without concern for the inserting direction.

Figure 5:
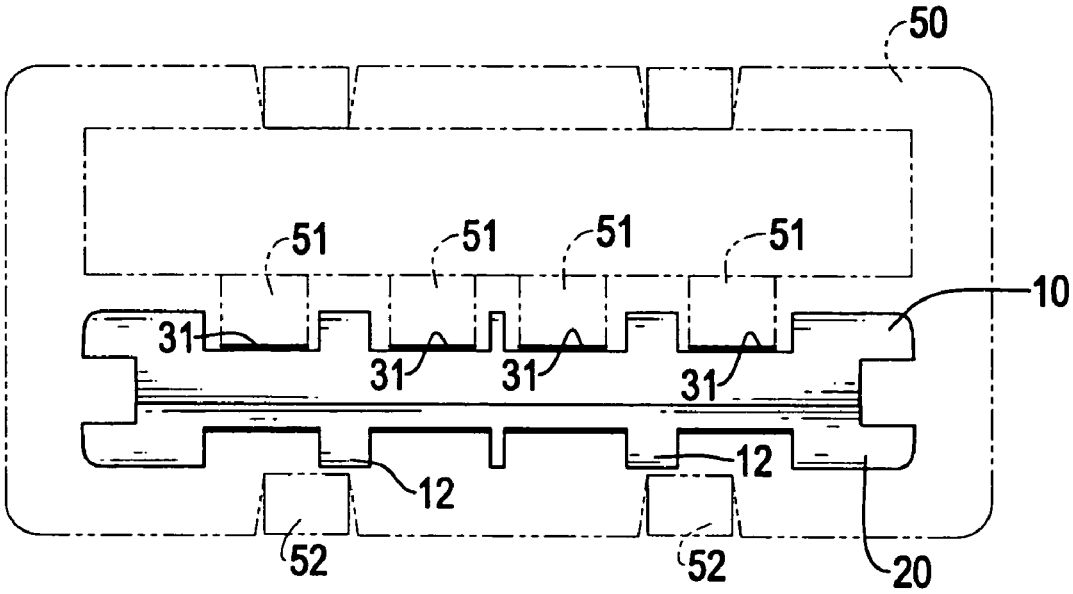
FIG. 5 is an operational side view showing the USB plug in accordance with the present invention is inserted into a standard USB port.
Figure 6:
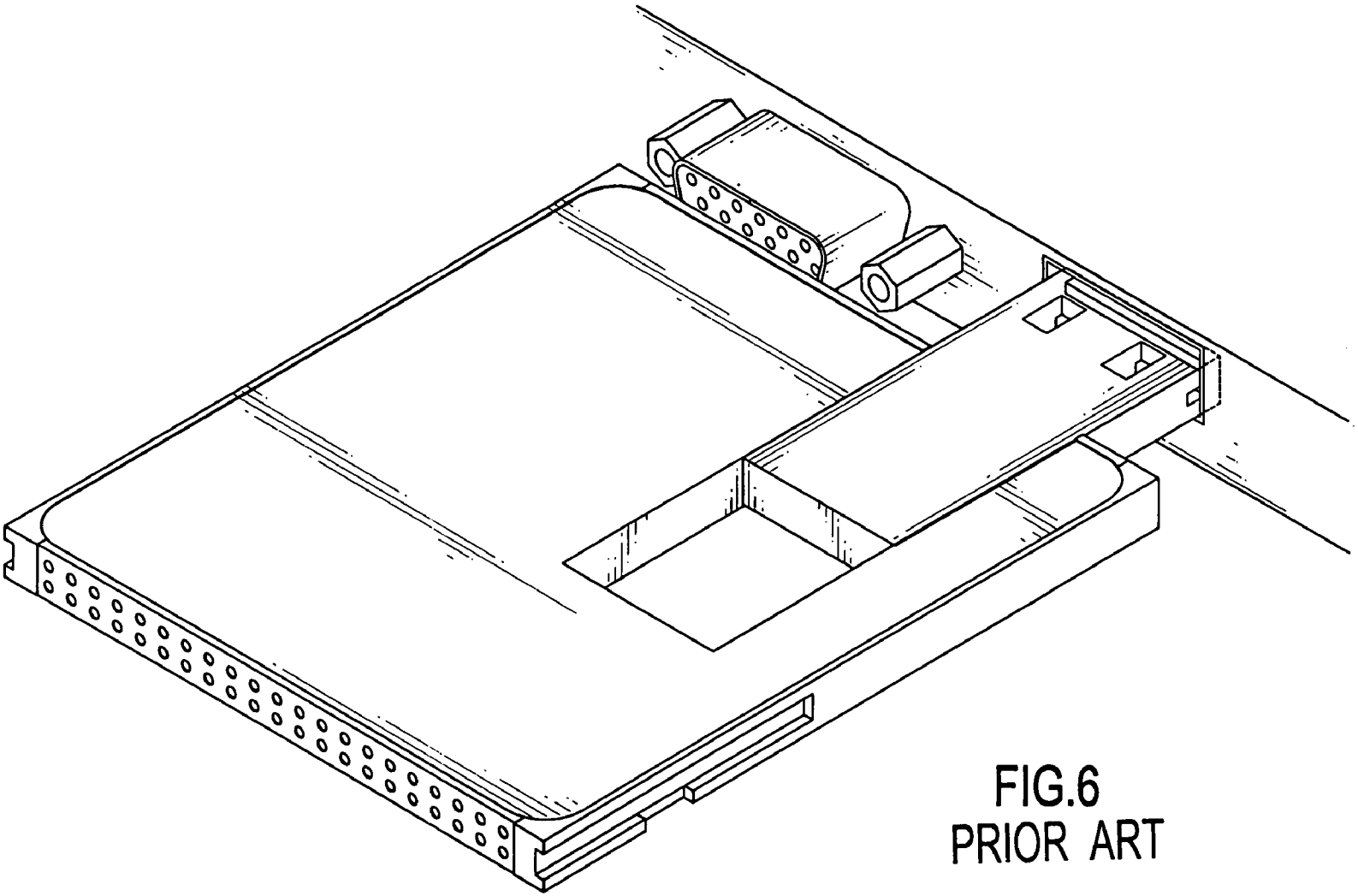
FIG.6 PRIOR ART
FIG. 6 is an operational view showing a memory card with a USB plug is intended to connect to a USB port.

With reference to FIG. 5, the USB plug in accordance with the present invention is inserted into a standard USB port (50). The USB port (50) has a plastic platform (53) with four conductive pins (51) embedded therein. When the USB plug is inserted into the port (50), the four USB contacts (31) formed on one side correspondingly touch the conductive pins (51). On the other side of the USB plug, since the protruding ribs (12) abut resilient metal tongues (52) inside the USB port (50), the contacts (31) on the other side will not touch to the metal tongues (52) thus avoiding the occurrence of a short circuit.

In conclusion, either the top or the bottom sides of the USB plug is able to electrically touch with the contacts formed in any standard USB port. Further, the entire thickness of the USB plug is within a range of 1.7–2.3 mm. The slim profile allows the USB plug to be integrated with thin electrical products such as memory cards.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A USB plug with two sides alternately connectable to a USB port, the USB plug comprising:

a top frame formed by a rectangular body in which first slots are defined through the body and multiple first ribs are formed among the first slots, wherein each first rib is formed between two adjacent first slots;

a bottom frame formed by a rectangular body in which second slots are defined through the body and correspond to first slots of the top frame and multiple second ribs are formed among the second slots, wherein each second rib is formed between two adjacent second slots; and a circuit board mounted between the top frame and the bottom frame, wherein the circuit board has a top side and a bottom side, four standard USB contacts are formed on both the top side and the bottom side near a front end of the circuit board to exactly correspond to the first and second slots;

wherein the circuit board is constructed from multiple circuit layers, the top layer and bottom layer form the USB contacts, the intervening layers provide a ground plate and an operating voltage.

2. The USB plug as claimed in claim 1, wherein multiple small concave dimples are defined at a bottom surface of the top frame, and multiple protruding stubs are formed on a top surface of the bottom frame to complementarily engage with the multiple dimples.

3. The USB plug as claimed in claim 1, the USB contacts comprising an operating voltage pin, two data pins and a ground pin.

4. The USB plug as claimed in claim 3, wherein the voltage pin of the first layer is electrically connected to the third layer through the second layer, and the ground pin of the first layer is electrically connected to the second layer.

5. The USB plug as claimed in claim 3, wherein the voltage pin of the fourth layer is electrically connected to the third layer, and the ground pin of the fourth layer is electrically connected to the second layer through the third layer.

6. The USB plug as claimed in claim 1, wherein when the circuit board is fitted between the frames and the frames are then assembled together, and peripheries of the two frames are further joined in with an ultrasonic welding technique.

7. The USB plug as claimed in claim 1 having a thickness in a range of 1.7 to 2.3 mm.

8. The USB plug as claimed in claim 1, wherein the multiple circuit layers comprises a first layer and a fourth layer that form the USB contacts, a second layer providing a ground plate and a third layer providing an operating voltage.

* * * * *